US008324790B1

(12) United States Patent
Hu

(10) Patent No.: US 8,324,790 B1
(45) Date of Patent: Dec. 4, 2012

(54) HIGH ILLUMINATION LED BULB WITH FULL EMISSION ANGLE

(76) Inventor: Wen-Sung Hu, Tainan (TW)

( * ) Notice: Subject to any disclaimer, the term of this patent is extended or adjusted under 35 U.S.C. 154(b) by 41 days.

(21) Appl. No.: 13/154,501

(22) Filed: Jun. 7, 2011

(51) Int. Cl.
*H01J 1/62* (2006.01)
*H01J 63/04* (2006.01)
*H01J 5/16* (2006.01)

(52) U.S. Cl. ..... 313/113; 313/110; 313/567; 362/547

(58) Field of Classification Search ..... None
See application file for complete search history.

(56) References Cited

U.S. PATENT DOCUMENTS 7,963,686 B2 * 6/2011 Hu ..... 362/547
2011/0013403 A1 * 1/2011 Hu ..... 362/311.02
2012/0014086 A1 * 1/2012 Jonsson ..... 362/84
2012/0014116 A1 * 1/2012 Hu ..... 362/335
2012/0056542 A1 * 3/2012 Hu ..... 315/113

* cited by examiner

*Primary Examiner* — Natalie Walford
(74) *Attorney, Agent, or Firm* — Alan Kamrath; Kamrath IP Lawfirm, PA

(57) ABSTRACT

A high illumination LED bulb includes a transparent lamp holder and a transparent reflective envelope having an inner face coated with a reflective membrane having light transmittance characteristic. A chamber is defined between the transparent lamp holder and the transparent reflective envelope and receives an actuator, a radiator and a light emitting module electrically connected to the actuator. The light emitting module includes a substrate disposed on the radiator and at least one LED disposed on the substrate. Light radiated from the LED is transmitted to produce superior projection beam by the transparent reflective envelope and reflected to produce inferior projection beam by the reflective membrane. Reflected halo formed by projection of the superior projection beam and the inferior projection beam on the transparent lamp holder and the transparent reflective envelope can form side projected halo, thereby radiating light with a full emission angle.

7 Claims, 16 Drawing Sheets

HIGH ILLUMINATION LED BULB WITH FULL EMISSION ANGLE

BACKGROUND OF THE INVENTION

1. Field of the Invention

The present invention relates to a LED bulb and, more particularly, to a high illumination LED bulb with a full emission angle.

2. Description of the Related Art

As the green energy policy is highly promoted in international society, many advanced countries have thus set up the utilization deadline for tungsten bulbs. Light-emitting diode (LED) bulbs thus gradually enter the replacement market of tungsten bulbs.

Light emitting modules of conventional tungsten-filament bulbs radiate 360 degree projection light, while light bulbs 2, 3, and 4 (as shown in FIGS. 1, 2, and 3) using LED (SMD or chip) as light emitting modules can only radiate projection light with single direction. Thus, the designs of LED bulbs 2, 3, and 4 which project light in single direction can only be used for downlights projecting from ceiling to ground. If the LED bulbs 2, 3, 4 are to be used in a standing lamp 5 (see FIG. 19), a desk lamp 6 (FIG. 20), a wall lamp 7 (FIG. 21) or a bed lamp, the projection direction can only point to the ceiling (see D1 of FIG. 4). The projection light toward the floor can only rely on the reflected light shined on the slope of the lampshade of the standing lamp, desk lamp, wall lamp or bed lamp (see D2 of FIG. 4). It is obviously that the reflected light does not provide enough illumination intensity. Thus, after tungsten bulbs disappear in the market, such types of lamps will all be replaced by energy saving bulbs such as hot cathode fluorescent lamps (HCFL) or cold cathode fluorescent lamps (CCFL).

However, HCFL and CCFL type energy saving bulbs have ultraviolet light, electromagnetic wave, and radiation which are harmful to human body. Hence, if they are used close to human body, the injury will be larger. Furthermore, they contain composition such as Hg, Ar, and Ne, wherein Hg is harmful to human's brain, kidney and skin and is a contaminating material to the land too. Further, since the lamp bodies of HCFL and CCFL are usually of glass material, which are very fragile, when they are broken, Hg metal might get released, and once it is contacted by human bodies or is inhaled by human, it will cause brain and kidney disease. Moreover, it takes great cost to decompose the toxicity of the rejected product of HCFL, CCFL, and it does not meet the environmental requirement too. In addition, similar to fluorescent lamps, discharge of HCFL and CCFL type bulbs is a result of the impact of electrode with Hg gas. The generated light beam is of discontinuous light, which will cause vision fatigue of the eye and does not facilitate the reading.

Thus, how to design LED bulbs to match the utilization of lamps such as standing lamps, desk lamps, wall lamps or bed lamps and to increase the illumination scope of the projection light is really the top urgent matter of the LED industries; and it is an important way to promote the concept of environmental protection and energy saving.

BRIEF SUMMARY OF THE INVENTION

Therefore, it is an objective of the present invention to overcome the aforementioned shortcoming and deficiency of the prior art by providing a high illumination LED bulb with a full emission angle. The high illumination LED bulb includes a transparent lamp holder, a transparent reflective envelope, a radiator, and a light emitting module. The transparent lamp holder includes spaced lower and upper ends. A bulb socket is mounted to the lower end of the transparent lamp holder, and an opening is formed in the upper end of the transparent lamp holder. The transparent reflective envelope is connected to the upper end of the transparent lamp holder and covers the opening of the transparent lamp holder. A chamber is formed between the transparent lamp holder and the transparent reflective envelope, and an actuator is installed in the chamber. The transparent reflective envelope includes an inner surface coated with a reflective membrane having light transmittance characteristic. The radiator is received in the chamber and includes an upper surface facing the transparent reflective envelope and a lower surface facing the bulb socket. The light emitting module includes a substrate located on the upper surface of the radiator and at least one LED disposed on the substrate. The light emitting module is electrically connected to the actuator so that the LED can be driven to radiate a light beam. The light beam radiated from the LED is transmitted to produce a superior projection beam by the transparent reflective envelope and is reflected to produce an inferior projection beam by the reflective membrane of the transparent reflective envelope.

Accordingly, the high illumination LED bulb of the present invention can be applied in the LED bulbs of stand lights, desk lamps, wall lamps and bed lamps, etc., to produce light with a full emission angle. As a result, both the requirements for indoors illumination effects and reading are met.

In a preferred form, the high illumination LED bulb further includes a transparent shell connected to the upper end of the transparent lamp holder. The transparent reflective envelope is disposed between the transparent shell and the light emitting module. The light radiated from the LED is transmitted via the transparent reflective envelope and the transparent shell to form the superior projection beam.

Preferably, the transparent reflective envelope includes a central portion formed as a convex lens body with the thickness of the lens body gradually decreasing from a center towards a periphery of the transparent reflective envelope.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

DETAILED DESCRIPTION OF THE INVENTION

Figure 2:
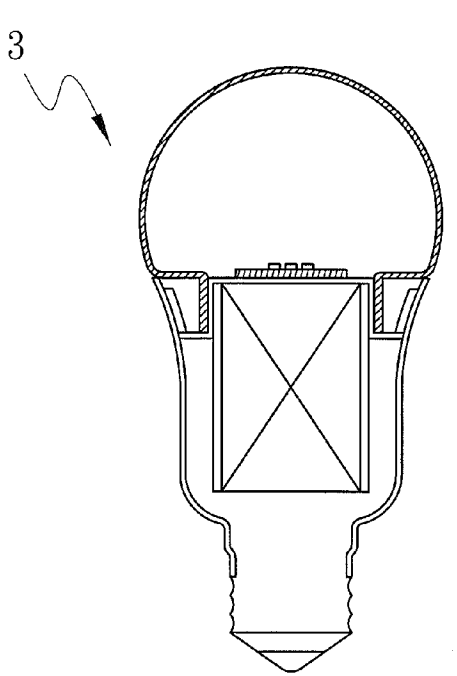
FIG. 2 Prior Art
FIG. 2 is a schematic view of a second conventional bulb.
Figure 1:
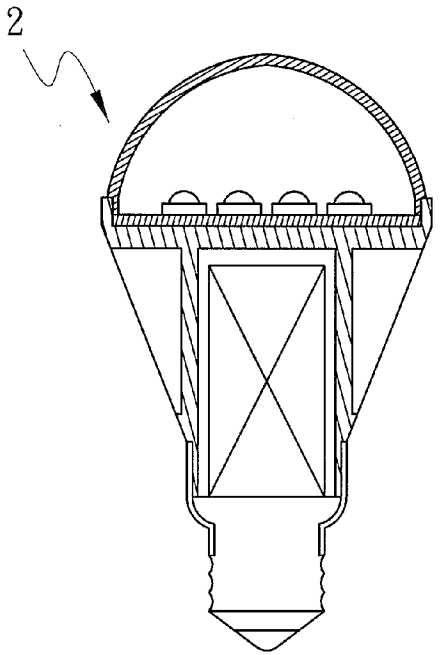
FIG. 1 Prior Art
FIG. 1 is a schematic view of a first conventional bulb.
Figure 4:
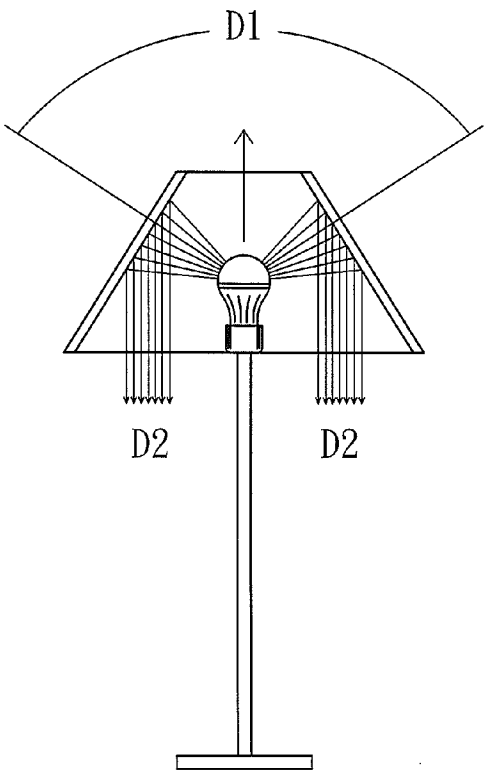
FIG. 4 Prior Art
FIG. 4 is a view of projection beams of a convention light bulb used in a standing lamp.
Figure 3:
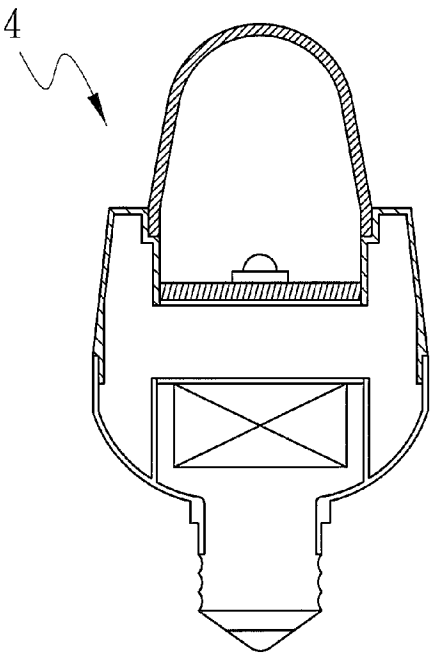
FIG. 3 Prior Art
FIG. 3 is a schematic view of a third conventional bulb.
Figure 5:
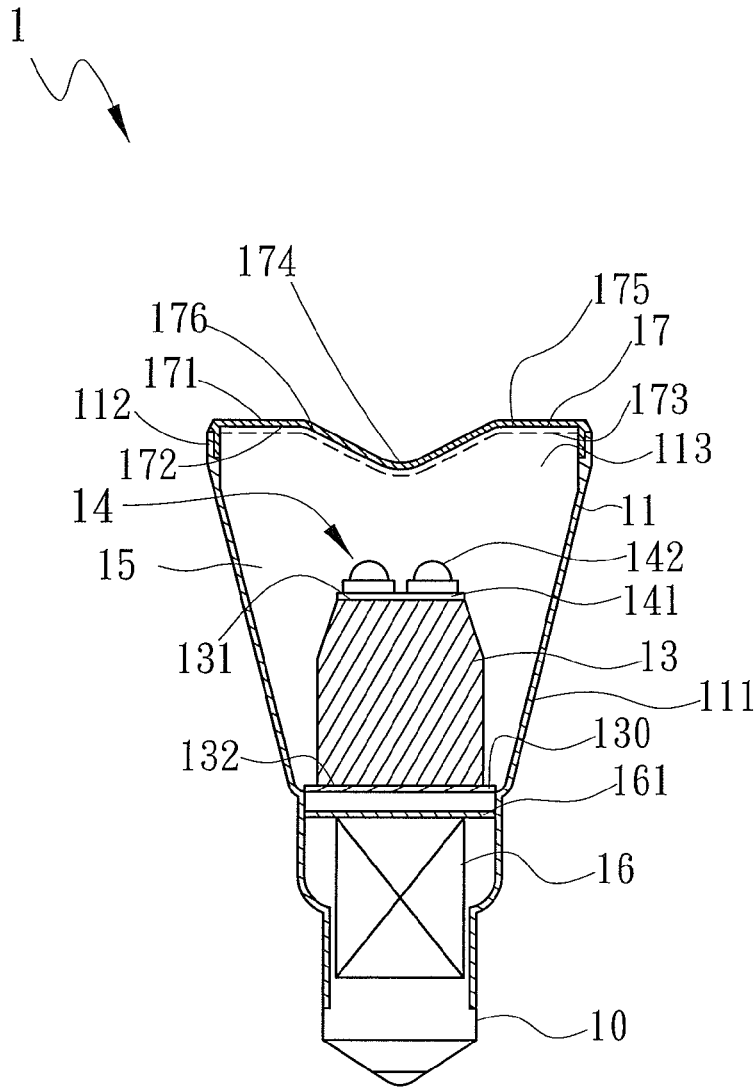
FIG. 5 is a cross sectional view of a LED bulb according to a first embodiment of the present invention.

A high illumination LED bulb of a first embodiment of the present invention is shown in FIG. 5 of the drawings and generally designated 1. The LED bulb 1 includes a transparent lamp holder 11, a radiator 13, a light emitting module 14, and a transparent reflective envelope 17. The transparent lamp holder 11 includes spaced lower and upper ends 111 and 112. A bulb socket 10 for tungsten-filament bulb is installed to the lower end 111 of the transparent lamp holder 11. The transparent lamp holder 11 is formed in a receptacle shape with an opening 113 in the upper end 112 of the transparent lamp holder 11.

The transparent reflective envelope 17 is engaged to the upper end 112 of the transparent lamp holder 11 to seal up the opening 113 so that a closed chamber 15 is formed between the transparent reflective envelope 17 and the transparent lamp holder 11. An actuator 16 is installed inside the chamber 15. The actuator 16 is disposed above the bulb socket 10, and a circuit board 161 is provided on an upper face of the actuator 16. The transparent reflective envelope 17 includes an outer surface 171 and an inner surface 172 facing the light emitting module 14. The inner surface 172 of the transparent reflective envelope 17 is coated with a reflective membrane 173 having light transmittance characteristic. In this embodiment, a central portion 174 of the transparent reflective envelope 17 is in a concave shape, and an outer annular portion 175 of the transparent reflective envelope 17 is flat. An arc angle 176 is formed at an intersection point of the central portion 174 and the outer annular portion 175.

The radiator 13 is disposed inside the chamber 15 and supported by a supporting board 130 located above the circuit board 161. The radiator 13 includes an upper surface 131 facing the transparent reflective envelope 17 and a lower surface 132 facing the bulb socket 10.

The light emitting module 14 includes a substrate 141 disposed on upper surface 131 of the radiator 13 and a plurality of LEDs (SMD/chip) 142 disposed on the substrate 141. Heat generated by the light emitting module 14 is radiated to the external surrounding through the radiator 13. The light emitting module 14 is connected electrically to the actuator 16 so that the LEDs 142 can be actuated to project light towards the transparent reflective envelope 17.

Figure 6:
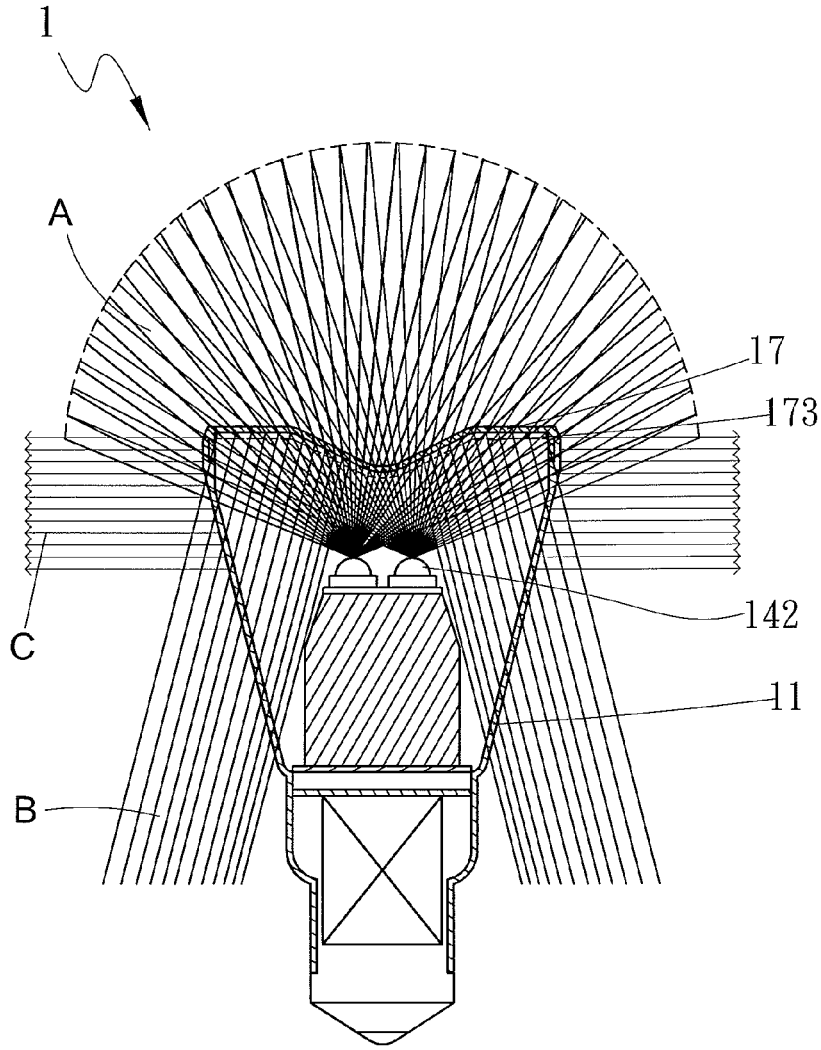
FIG. 6 is an illustration of projection beams of the LED bulb FIG. 5.

FIG. 6 shows the light emission effects of the high illumination LED bulb 1 of the present invention. Light radiated from the LEDs 142 is transmitted by the transparent reflective envelope 17 to form superior projection beam (A), and is reflected by the reflective membrane 173 to form inferior projection beam (B). Further, reflected halo formed by projection of superior projection beam (A) and the inferior projection beam (B) on the transparent lamp holder 11 and the transparent reflective envelope 17 can form side projected halo (C) in between the superior projection beam (A) and the inferior projection beam (B), in order to radiate light with a full emission angle. Furthermore, the concave shaped central portion 17 of the transparent reflective envelope 17 can increase the reflected emission angle to allow the high illumination LED bulb 1 to produce effects of wide-angle illumination.

Figure 7:
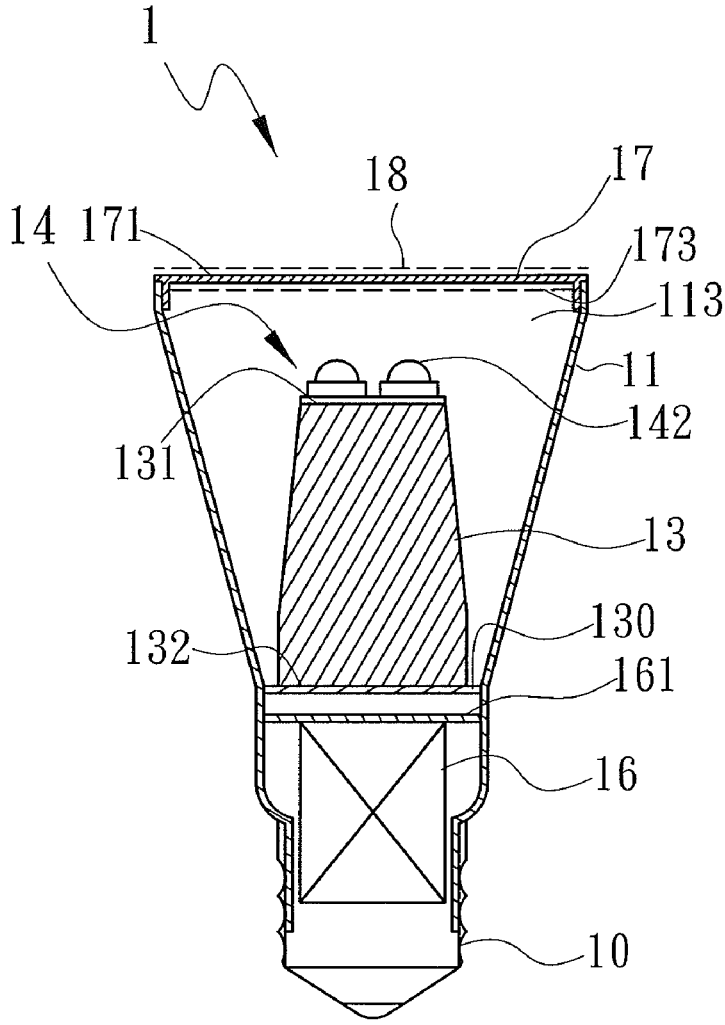
FIG. 7 is a cross sectional view of a LED bulb according to a second embodiment of the present invention.

FIG. 7 shows a high illumination LED bulb 1 of a second preferred embodiment of the present invention modified from the first embodiment. Description of the parts of the LED bulb 1 shown in FIG. 7 identical to those shown in FIG. 5 is omitted. In this embodiment, the transparent reflective envelope 17 is formed flatly. In other words, the central portion of the transparent reflective envelope 17 does not have a concave shape. Furthermore, a matte structure 18 is formed on the outer surface 171 of the transparent reflective envelope 17 by matte processing (such as sandblasting), matte paper paste, laser processing, or injection molding. The matte structure 18 may eliminate the section difference of luminance outside the projection aperture to form a visible residual light and widen the illumination area to achieve the purpose of even lighting effects.

Figure 8B:
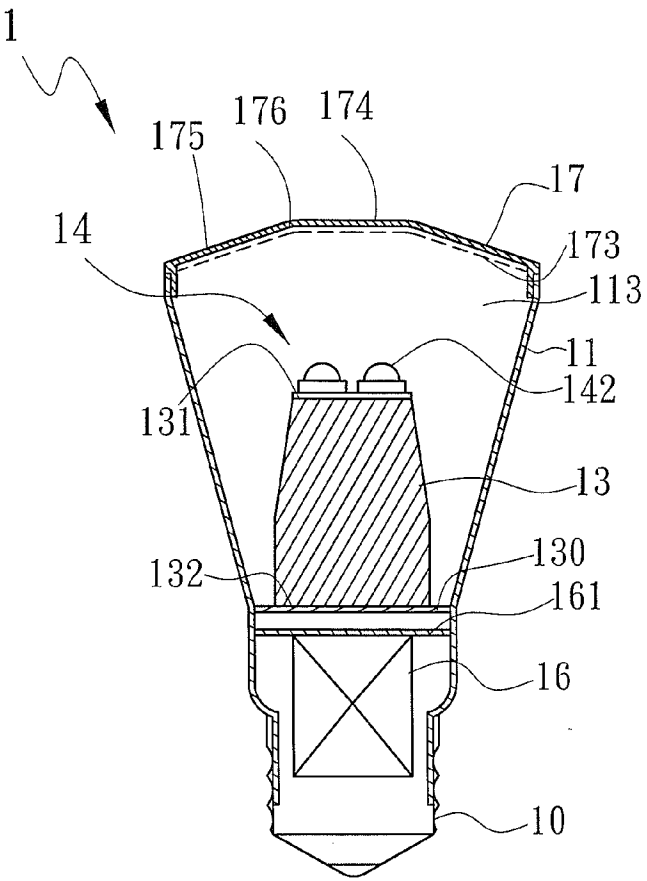
FIGS. 8*a* and 8*b* are two cross sectional views of LED bulbs according to third and fourth embodiments of the present invention.
Figure 8A:
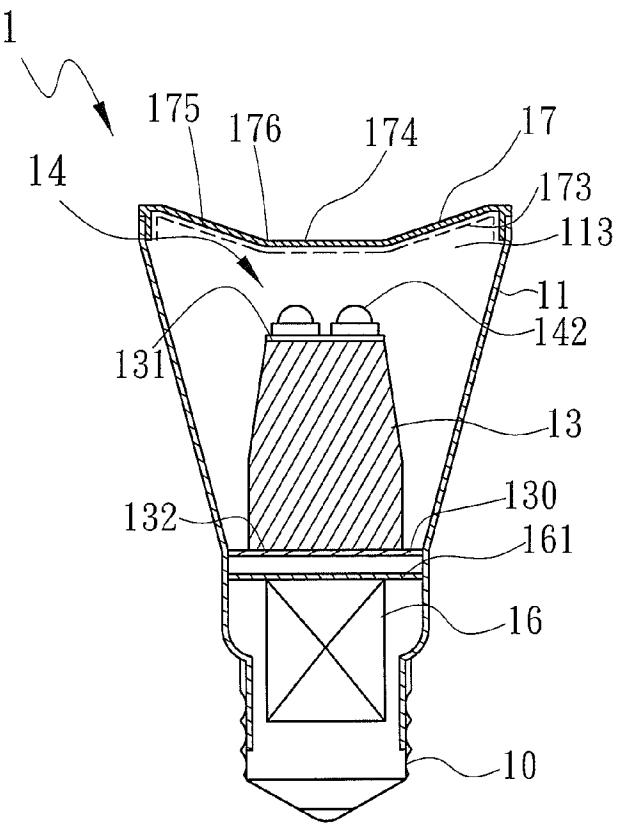

FIGS. 8*a* and 8*b* show high illumination LED bulbs 1 of third and fourth preferred embodiments of the present invention. Wherein, the outer annular portion 175 of the transparent reflective envelope 17 in FIG. 8*a* inclines downward, and the central portion 174 of the transparent reflective envelope 17 in FIG. 8*a* is formed flatly. An arc angle 176 is formed at the intersection point of the central portion 174 and the outer annular portion 175. While the outer annular portion 175 of the transparent reflective envelope 17 in FIG. 8*b* inclines upward and the central portion 174 of the transparent reflective envelope 17 in FIG. 8*b* is formed flatly. An arc angle 176 is formed at the intersection point of the central portion 174 and the outer annular portion 175.

Figure 9B:
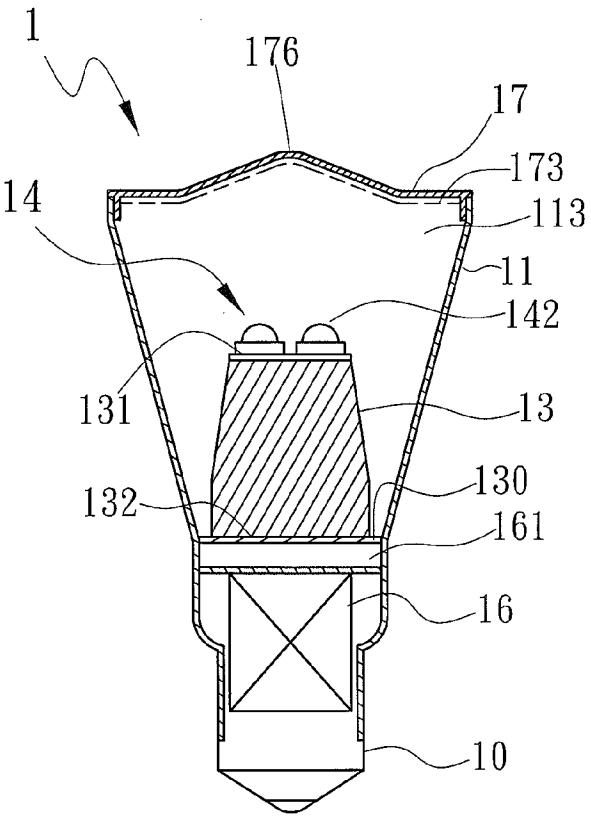
FIGS. 9*a* and 9*b* are two cross sectional views of LED bulbs according to fifth and sixth embodiments of the present invention.
Figure 9A:
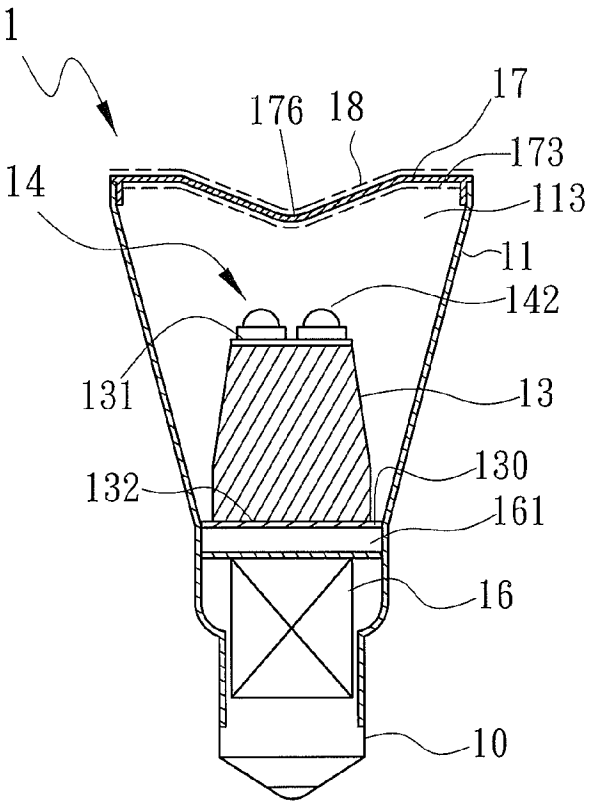

FIGS. 9*a* and 9*b* show high illumination LED bulbs 1 of fifth and sixth preferred embodiments of the present invention. Wherein, the transparent reflective envelope 17 in FIG. 9*a* is designed in concave V-shape, while the transparent reflective envelope 17 in FIG. 9*b* is formed in an inverted V-shape. Furthermore, the top end of transparent reflective envelope 17 in FIG. 9*b* is formed as arc angle 176.

Figure 10B:
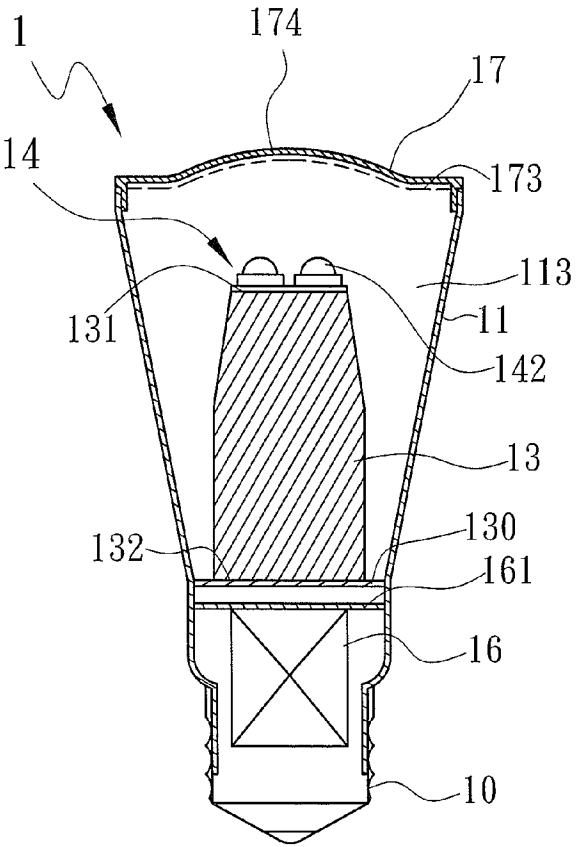
FIGS. 10*a* and 10*b* are two cross sectional views of LED bulbs according to seventh and eighth embodiments of the present invention.
Figure 10A:
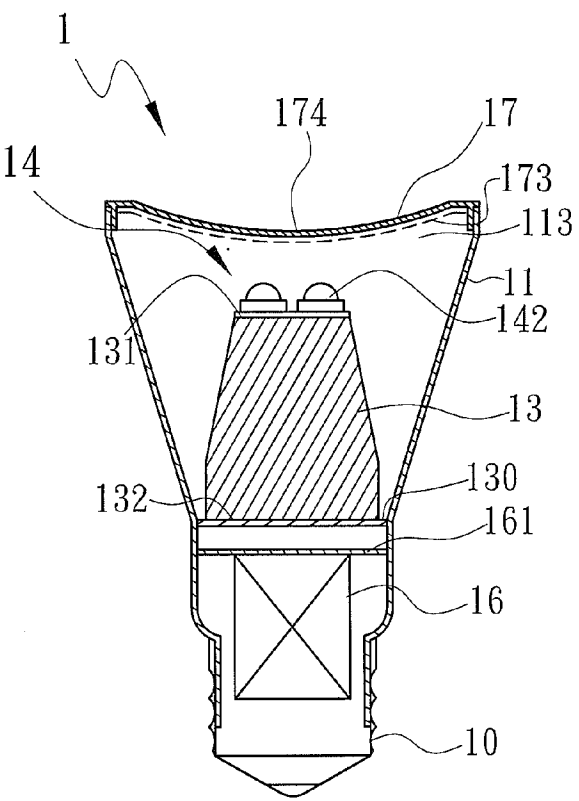

FIGS. 10*a* and 10*b* show high illumination LED bulbs 1 of seventh and eighth preferred embodiments of the present invention. Wherein, the central portion 174 of the transparent reflective envelope 17 in FIG. 10*a* is designed in a concave-arc shape, while the central portion 174 of the transparent reflective envelope 17 in FIG. 10*b* is designed in a convex-arc shape.

The preferred embodiments in FIGS. 8 through 10 show that the central portion 174 of the transparent reflective envelope 17 can be formed in a concave shape or a convex shape to produce different reflection angles. Thus, high illumination LED bulb 1 of the present invention can meet various requirements and demands. Wherein, the transparent reflective envelope 17 with concave central portion design can increase the reflection angle, while the transparent reflective envelope 17 with convex central portion design can enhance light-condensing effects.

Figure 12:
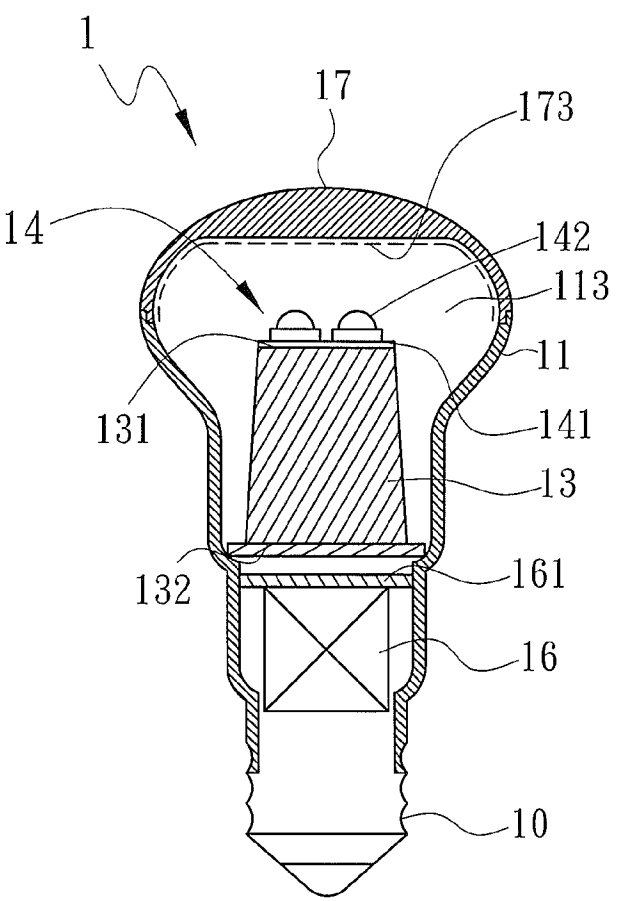
FIG. 12 is a cross sectional view of a LED bulb according to a tenth embodiment of the present invention.
Figure 11:
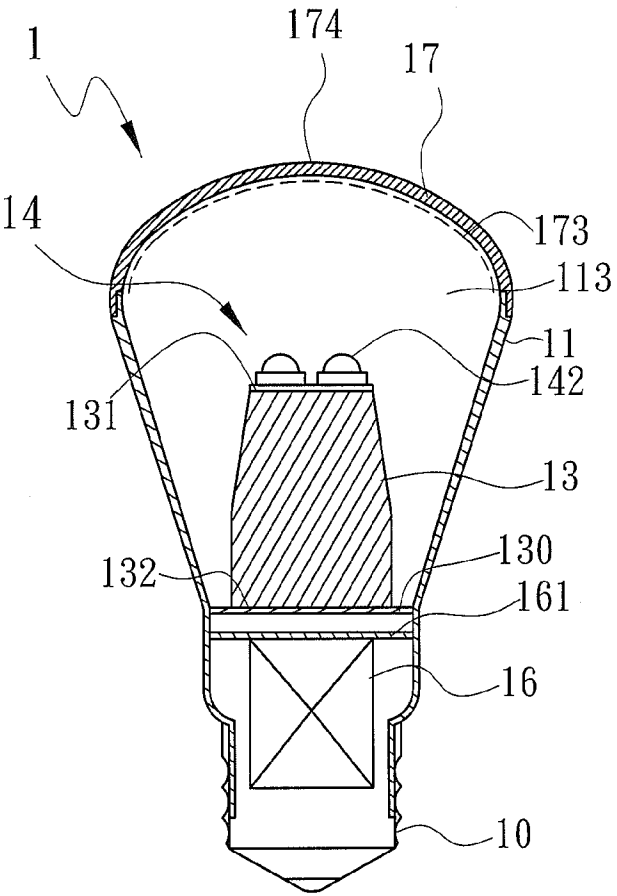
FIG. 11 is a cross sectional view of a LED bulb according to a ninth embodiment of the present invention.
Figure 14:
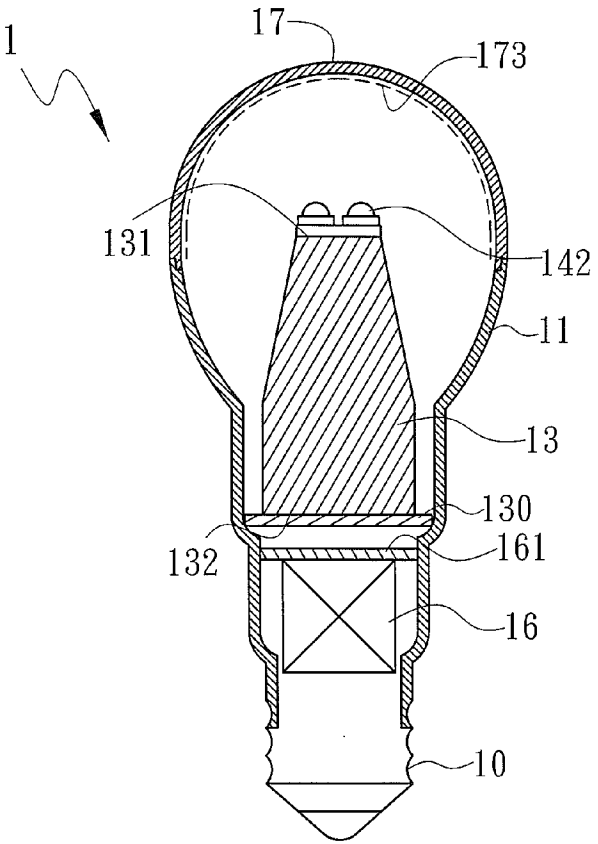
FIG. 14 is a cross sectional view of a LED bulb according to a twelfth embodiment of the present invention.
Figure 13:
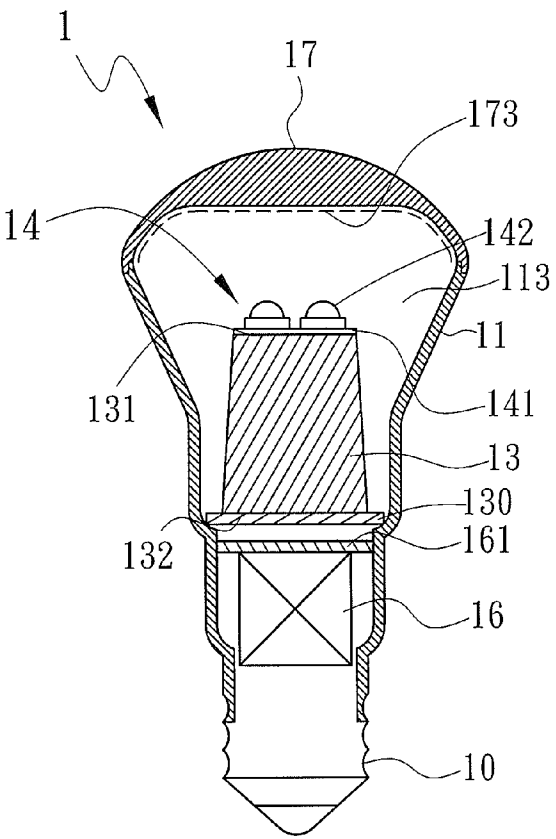
FIG. 13 is a cross sectional view of a LED bulb according to a eleventh embodiment of the present invention.

FIGS. 11 through 14 show high illumination LED bulbs 1 of four preferred embodiments of the present invention. Wherein, the central portion 174 of the transparent reflective envelope 17 in FIG. 11 is in a convex shape to allow projected light from the light emitting module 14 to form high intensity of light with wide focusing effects. FIGS. 12 and 13 show that the central portion 174 of the transparent reflective envelope 17 is formed as a convex lens body with the thickness of the lens body gradually decreasing from a center towards a periphery of the transparent reflective envelope 17 so as to enhance the intensity of projected light. FIG. 14 shows that the transparent reflective envelope 17 is in a semi-spherical shape.

Figure 15:
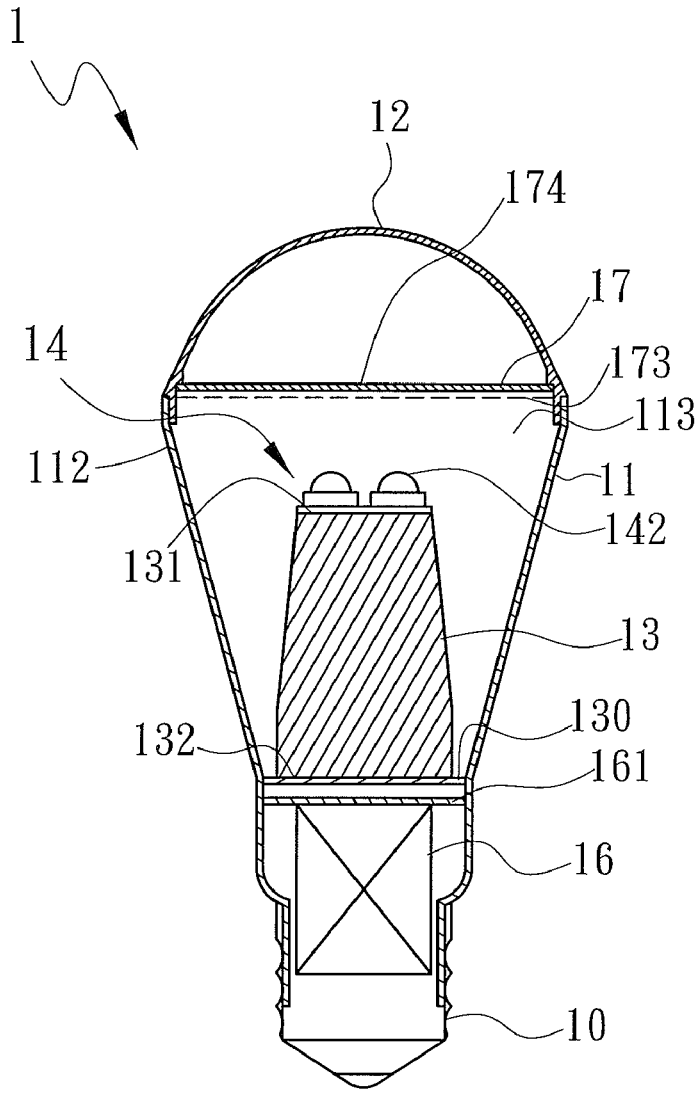
FIG. 15 is a cross sectional view of a LED bulb according to a thirteenth embodiment of the present invention.

FIG. 15 shows a high illumination LED bulb 1 of another preferred embodiment of the present invention. In this embodiment, LED bulb 1 further includes a transparent shell 12 connected to the upper end 112 of the transparent lamp holder 11 such that the transparent reflective envelope 17 is disposed between the transparent shell 12 and the light emitting module 14. Light radiated from the LEDs 142 is transmitted via the transparent reflective envelope 17 and the transparent shell 12 to form the superior projection beam. Accordingly, the intensity of the superior projection beam can be further enhanced.

Figure 16B:
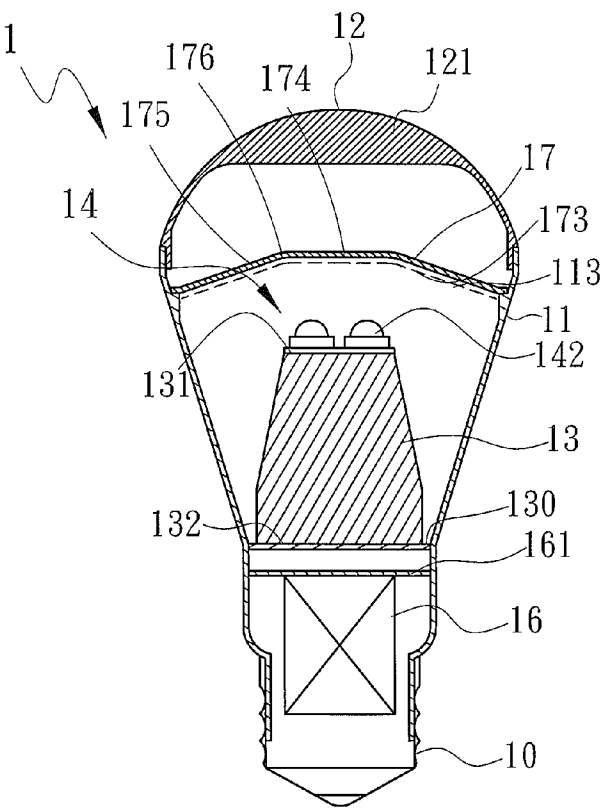
FIGS. 16*a* and 16*b* are two cross sectional views of LED bulbs according to fourteenth and fifteenth embodiments of the present invention.
Figure 16A:
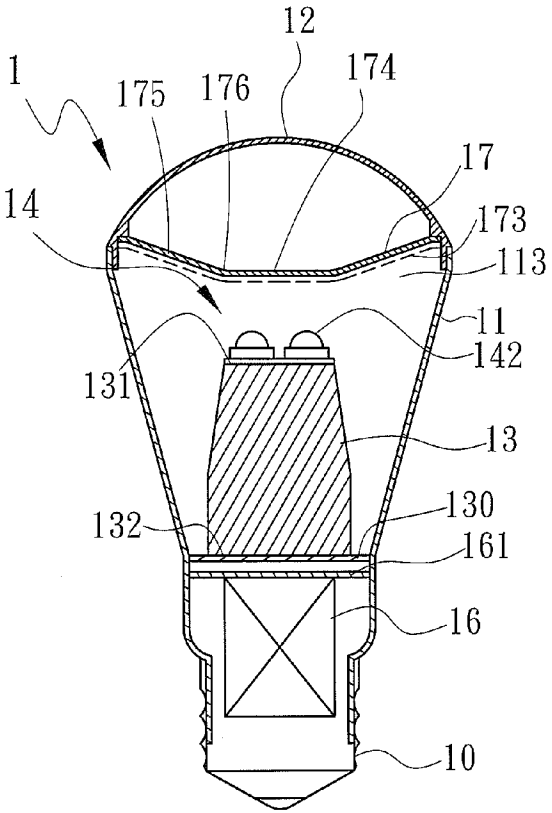
Figure 17B:
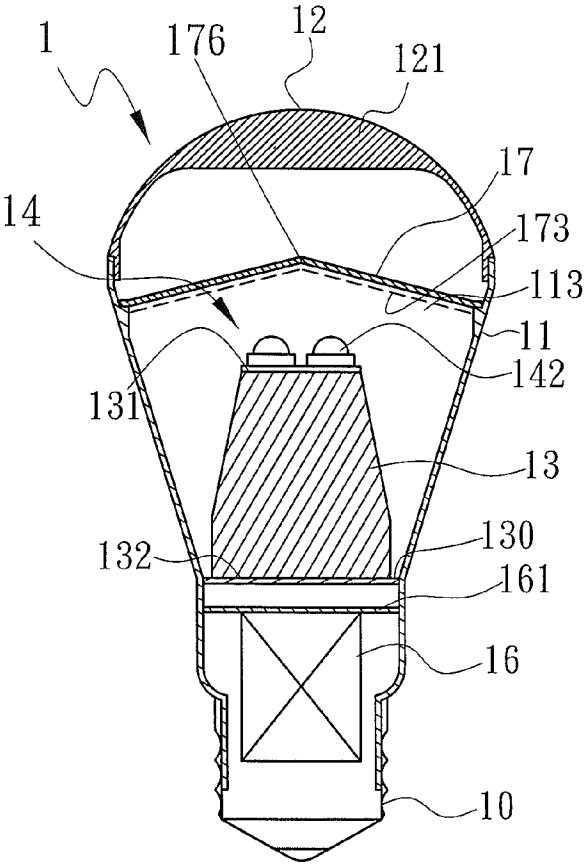
FIGS. 17*a* and 17*b* are two cross sectional views of LED bulbs according to sixteenth and seventeenth embodiments of the present invention.
Figure 17A:
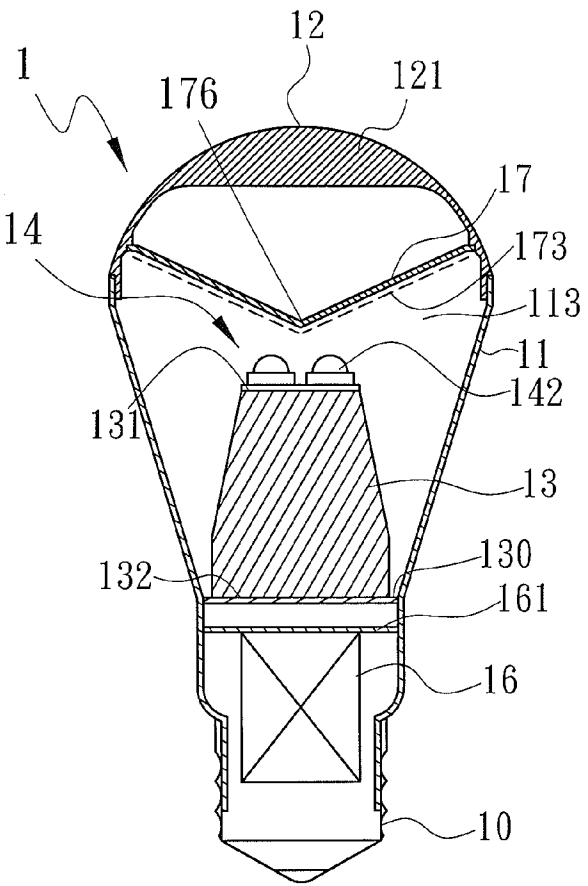
Figure 18B:
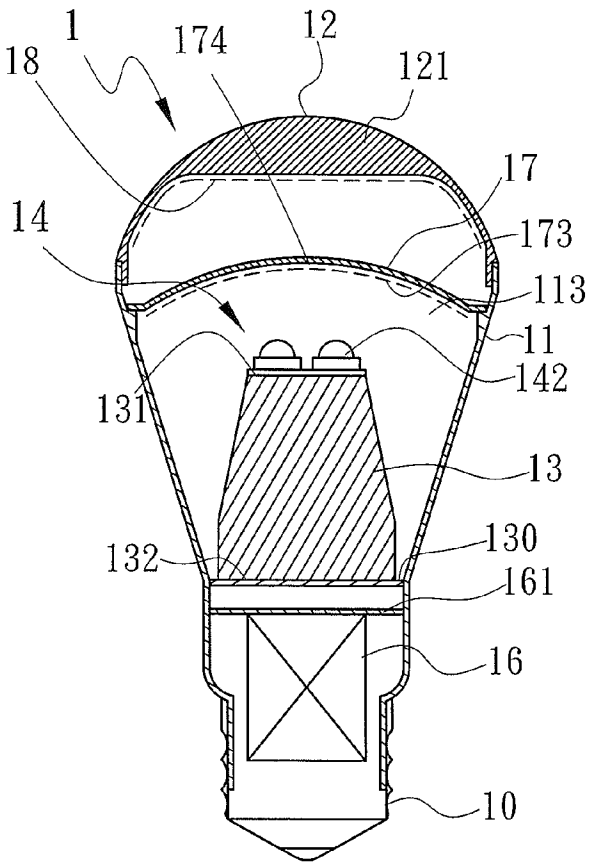
FIGS. 18*a* and 18*b* are two cross sectional views of LED bulbs according to eighteenth and nineteenth embodiments of the present invention.
Figure 18A:
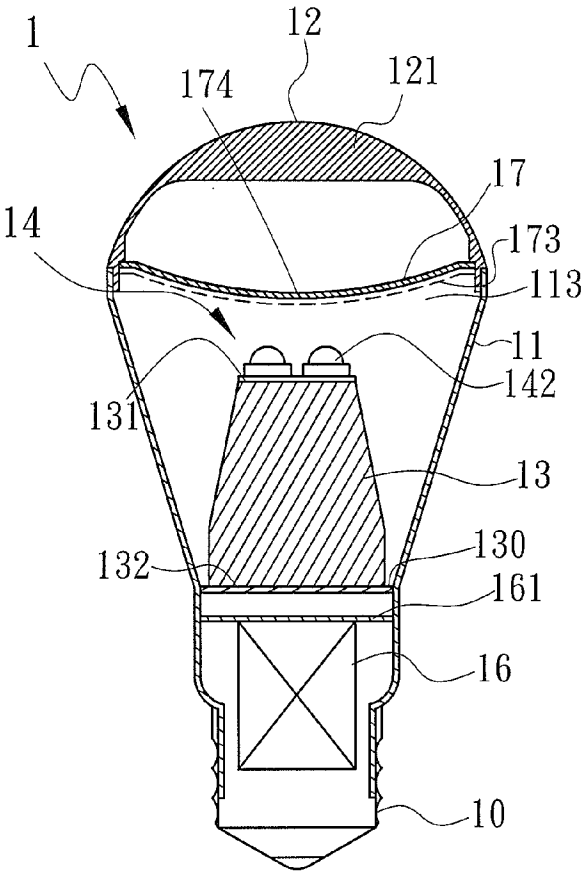

FIGS. 16 through 18 show high illumination LED bulbs 1 of another few preferred embodiments of the present invention with LED bulb 1 including the transparent reflective envelope 17 and transparent shell 12. Wherein, the central portion 174 of the transparent reflective envelope 17 in FIG. 16*a* is in concave shape so that light radiated from the light emitting module 14 can be projected at a wide emission angle. The central portion 174 of the transparent reflective envelope 17 in FIG. 16*b* is in convex shape, and the central portion of the transparent shell 12 is formed as a convex lens body 121 so that light projected straightly can be intensified. The transparent reflective envelope 17 in FIG. 17*a* is formed in a concave V-shape while the transparent reflective envelope 17 in FIG. 17*b* is in a convex inverted V-shape. The central portion 174 of the transparent reflective envelope 17 in FIG. 18*a* is formed in concave arc-shape while the central portion 174 of the transparent reflective envelope 17 in FIG. 18*b* is formed in convex arc-shape. Further, the inner surface of the transparent shell 12 in FIG. 18*b* has the matte structure 18.

Figure 20:
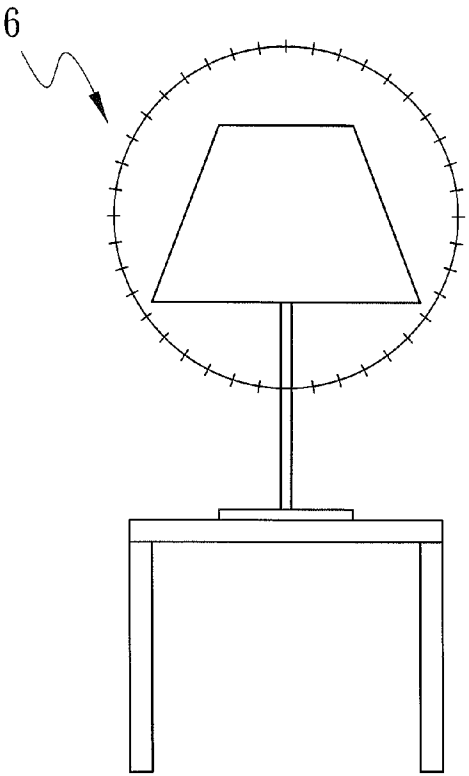
FIG. 20 shows a schematic view of a desk lamp with a full emission angle projection of the LED bulb of the present invention used in the desk lamp.
Figure 19:
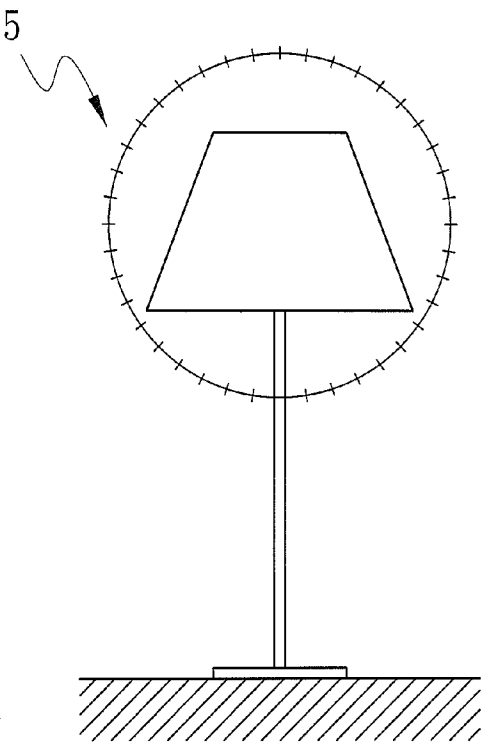
FIG. 19 shows a schematic view of a standing lamp with a full emission angle projection of the LED bulb of the present invention used in the standing lamp.
Figure 22:
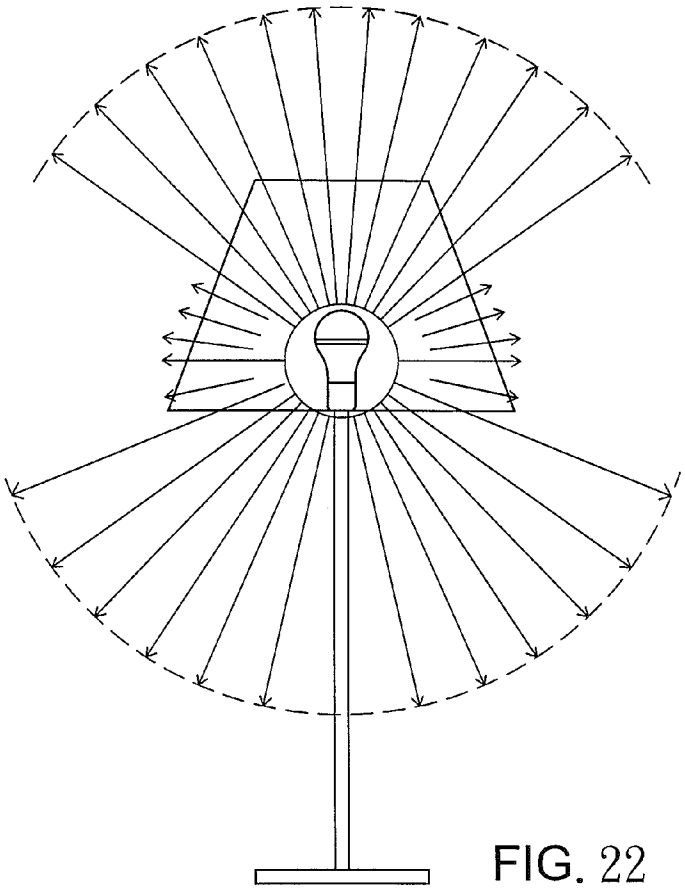
FIG. 22 is an illustration of projection beams of the LED bulb of the present invention used in the standing lamp.
Figure 21:
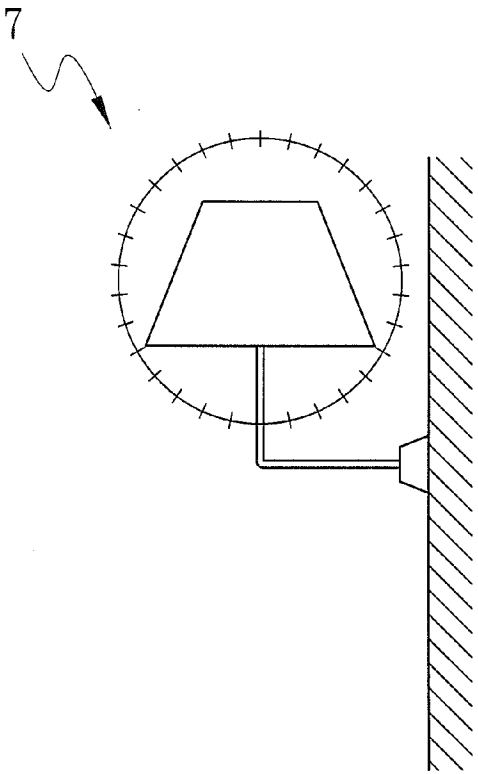
FIG. 21 shows schematic view of a wall lamp with a full emission angle projection of the LED bulb of the present invention used in the wall lamp.

The high illumination LED bulb 1 of the present invention can be applied in stand light 5 as shown in FIG. 19, desk lamp 6 in FIG. 20, wall lamp 7 or bed lamp in FIG. 21. Further, FIG. 22 shows the light illumination effects of high illumination LED bulb 1 of the present invention applied in stand light 5, wherein the high illumination LED bulb 1 has illumination effects of full emission angle.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A high illumination LED bulb comprising, in combination:

a transparent lamp holder including spaced lower and upper ends, with a bulb socket mounted to the lower end of the transparent lamp holder, with an opening formed in the upper end of the transparent lamp holder;

a transparent reflective envelope connected to the upper end of the transparent lamp holder and covering the opening of the transparent lamp holder, with a chamber formed between the transparent lamp holder and the transparent reflective envelope, with an actuator installed in the chamber, with the transparent reflective envelope including an inner surface coated with a reflective membrane having light transmittance characteristic;

a radiator received in the chamber and including an upper surface facing the transparent reflective envelope and a lower surface facing the bulb socket; and a light emitting module including a substrate located on the upper surface of the radiator and at least one LED disposed on the substrate, with the light emitting module electrically connected to the actuator so that the LED can be driven to radiate a light beam, and with the light beam radiated from the LED being transmitted to produce a superior projection beam by the transparent reflective envelope and being reflected to produce a inferior projection beam by the reflective membrane of the transparent reflective envelope.

2. The high illumination LED bulb according to claim 1, further comprising: a transparent shell connected to the upper end of the transparent lamp holder, with the transparent reflective envelope disposed between the transparent shell and the light emitting module, and with the light radiated from the LED being transmitted via the transparent reflective envelope and the transparent shell to form the superior projection beam.

3. The high illumination LED bulb according to claim 2, with the transparent reflective envelope including a central portion formed in a concave shape or a convex shape.

4. The high illumination LED bulb according to claim 2, with the transparent reflective envelope including a central portion formed as a convex lens body with the thickness of the lens body gradually decreasing from a center towards a periphery of the transparent reflective envelope.

5. The high illumination LED bulb according to claim 2, with the transparent reflective envelope including an outer surface provided with a matte structure, and with the transparent shell including a central portion formed as a convex lens body with the thickness of the lens body gradually decreasing from a center towards a periphery of the transparent shell.

6. The high illumination LED bulb according to claim 1, with the transparent reflective envelope including a central portion formed in a concave shape or a convex shape.

7. The high illumination LED bulb according to claim 1, with the transparent reflective envelope including a central portion formed as a convex lens body with the thickness of the lens body gradually decreasing from a center towards a periphery of the transparent reflective envelope.

* * * * *